US006273690B1

(12) United States Patent
Fischer, Jr. et al.

(10) Patent No.: US 6,273,690 B1
(45) Date of Patent: Aug. 14, 2001

(54) DOWNHOLE PUMP WITH BYPASS AROUND PLUNGER

(75) Inventors: Charles K. Fischer, Jr., Fort Worth; Benny J. Williams, Keller, both of TX (US)

(73) Assignee: Harbison-Fischer Manufacturing Company, Crowley, TX (US)

( * ) Notice: Subject to any disclaimer, the term of this patent is extended or adjusted under 35 U.S.C. 154(b) by 0 days.

(21) Appl. No.: 09/599,017

(22) Filed: Jun. 21, 2000

Related U.S. Application Data

(60) Provisional application No. 60/141,106, filed on Jun. 25, 1999, and provisional application No. 60/144,592, filed on Jul. 20, 1999.

(51) Int. Cl.[7] ..... F04B 53/00

(52) U.S. Cl. ..... 417/555.2; 417/553; 417/554; 91/856; 91/402; 92/143

(58) Field of Search ..... 417/553, 554, 417/555.2; 91/402; 92/856, 143

(56) References Cited

U.S. PATENT DOCUMENTS

| | | | | |
|---|---|---|---|---|
| 2,371,846 | * | 3/1945 | Ruthven | 103/204 |
| 3,074,352 | | 1/1963 | Vincent . | |
| 3,479,958 | * | 11/1969 | Anderson et al. | 103/46 |
| 3,953,155 | * | 4/1976 | Roeder | 417/554 |
| 3,966,360 | * | 6/1976 | Greene | 417/53 |
| 4,531,584 | * | 7/1985 | Ward | 166/265 |
| 4,557,668 | | 12/1985 | Jones . | |
| 4,565,496 | | 1/1986 | Soderberg . | |
| 4,643,258 | | 2/1987 | Kime . | |
| 4,673,338 | | 6/1987 | Jones . | |
| 4,968,226 | | 11/1990 | Brewer . | |
| 5,141,411 | | 8/1992 | Klaeger . | |
| 5,653,286 | | 8/1997 | McCoy et al. . | |
| 5,660,534 | | 8/1997 | Snow . | |
| 6,015,010 | | 1/2000 | Kostrov . | |

* cited by examiner

*Primary Examiner*—Charles G. Freay
*Assistant Examiner*—Eric Hayes
(74) *Attorney, Agent, or Firm*—Geoffrey A. Mantooth

(57) ABSTRACT

The downhole pump has a barrel with a reciprocating plunger therein. The barrel has a first one-way valve, while the plunger has a second one-way valve. A barrel chamber is formed between the two one-way valves. The barrel chamber expands when the reciprocal movement between the plunger and the barrel is an upstroke movement and then contracts when the reciprocal movement is a downstroke movement. A bypass channel is provided between the barrel and the plunger so as to provide communication around the plunger and its one-way valve. The bypass channel is open when the reciprocal movement is near an end of the upstroke movement. When open, pressure across the plunger can equalize and gas inside the barrel chamber can vent around the plunger and/or pressure can equalize across the plunger one-way valve so as to prevent gas lock and minimize stress on the sucker rods. The bypass channel can be provided by reducing the diameter of the lower end of the plunger, increasing the diameter of the upper end of the barrel, putting grooves in the plunger or the barrel or by making the barrel out of two sections, namely a lower section and a wider upper section and providing holes in the lower end of the plunger below the plunger one-way valve.

16 Claims, 8 Drawing Sheets

DOWNHOLE PUMP WITH BYPASS AROUND PLUNGER

This application claims the benefit of the following U.S. provisional patent applications, Ser. No. 60/141,106, filed Jun. 25, 1999 and Ser. No. 60/144,592, filed Jul. 20, 1999.

FIELD OF THE INVENTION

The present invention relates to subsurface, or downhole, pumps, such as are used to pump oil and other fluids and bases from oil wells.

BACKGROUND OF THE INVENTION

When an oil well is first drilled and completed, the fluids (such as crude oil) may be under natural pressure that is sufficient to produce on its own. In other words, the oil rises to the surface without any assistance.

In many oil wells, and particularly those in fields that are established and aging, natural pressure has declined to the point where the oil must be artificially lifted to the surface. Subsurface pumps are located down in the well below the level of the oil. A string of sucker rods extends from the pump up to the surface to a pump jack device, or beam pump unit. A prime mover, such as a gasoline or diesel engine, or an electric motor, or a gas engine on the surface causes the pump jack to rock back and forth, thereby moving the string of sucker rods up and down inside of the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a chamber between the valves with fluid and then lifts the fluid up the tubing toward the surface.

One problem encountered in downhole pumps is that the chamber between the valves fails to fill completely with liquid. Instead, the chamber contains undissolved gas, air, or vacuum, which are collectively referred to herein as "gas".

Such failure to completely fill the chamber is attributed to various causes. In a gas lock situation or a gas interference situation, the formation produces gas in addition to liquid. The gas is at the top of the chamber, while the liquid is at the bottom, creating a liquid-to-gas interface. If this interface is relatively high in the chamber, gas interference results. In gas interference, the plunger (on the downstroke) descends in the chamber and hits the liquid-to-gas interface. The change in resistances causes a mechanical shock or jarring. Such a shock damages the pump, the sucker rods and the tubing.

If the liquid-to-gas interface is relatively low in the chamber, gas lock results, wherein insufficient pressure is built up inside of the chamber on the downstroke to open the plunger valve. The plunger is thus not charged with fluid and the pump is unable to lift anything. A gas locked pump, and its associated sucker rods and tubing, may experience damage from the plunger hitting the interface.

In a pump off situation, the annulus surrounding the tubing down at the pump has a low fluid level, and consequently a low fluid head is exerted on the barrel valve. In an ideal pumping situation, when the plunger is on the upstroke, the annulus head pressure forces annulus fluid into the chamber. However, with a pump off condition, the low head pressure is unable to force enough fluid to completely fill the chamber. Consequently, the chamber has gas or air (a vacuum) therein. A pump (and its associated equipment) that is in a pump off condition suffers mechanical shock and jarring as the plunger passes through the liquid-to gas interface. A restricted intake can also cause pump off.

Still another problem is sand. The plunger and the barrel are both made of metal. In order to provide for lubrication inbetween these two parts, a small clearance between the two is provided to allow oil to enter. When the well is producing sand, some sand may enter this clearance or spacing between the plunger and the barrel. The sand abrades the components, thereby shortening the life of the pump.

SUMMARY OF THE INVENTION

It is an object of the present invention to provide a downhole pump that does not suffer from the problems of gas and sand.

It is another object of the present invention to provide a downhole pump that does not become gas locked.

It is another object of the present invention to provide a downhole pump that minimizes pump damage caused by gas interference or pump off conditions.

The present invention provides a downhole pump having an unperforated barrel and a plunger. The barrel has first and second ends with a first one-way valve being located in the second end of the barrel. The plunger also has first and second ends. The plunger has a second one-way valve therein. The plunger second end is located inside of the barrel such that reciprocal movement between the plunger and the barrel can occur. There is a barrel chamber inside of the barrel and extending between the first one-way valve and the plunger. The barrel chamber expands when the reciprocal movement between the plunger and the barrel is an upstroke movement and the barrel chamber contracts when the reciprocal movement between the plunger and the barrel is a downstroke movement. A bypass channel is located between the plunger and the barrel. The bypass channel is closed when the reciprocal movement is beginning the upstroke movement and is open when the reciprocal movement is near an end of the upstroke movement. The open bypass channel allows communication from the barrel chamber around the plunger.

With the pump of the present invention, pressure across the plunger can be equalized as the plunger finishes its upstroke. Such pressure equalization may be necessary to correct for a pressure differential caused by gas in the chamber. The gas is vented through the bypass channel. Consequently, the pump does not suffer gas lock and stress on the sucker rods is reduced. Also, circulation through the bypass minimizes the buildup of sand.

In accordance with one aspect of the present invention, the plunger comprises an outside diameter. The bypass chamber is formed by a reduction of the outside diameter near the plunger second end.

In accordance with still another aspect of the present invention, the plunger comprises an outside diameter. The bypass channel is formed by at least one groove in the outside diameter extending in a generally longitudinal direction along the plunger. The groove is located near the plunger second end.

In accordance with still another aspect of the present invention, the bypass channel has a cross-sectional area that increases as the reciprocal movement between the plunger and the barrel nears the end of the upstroke movement.

In accordance with still another aspect of the present invention, the barrel comprises an inside diameter. The bypass channel comprises an increase of the inside diameter near the barrel first end.

In accordance with still another aspect of the present invention, the barrel comprises an inside diameter. The bypass channel comprises at least one groove in the inside diameter extending in a generally longitudinal direction along the barrel. The groove is located near the barrel first end.

The present invention also provides a downhole pump comprising a barrel and a plunger. The plunger has one end located inside of the barrel. The plunger end forms part of a chamber located inside of the barrel. The barrel and the plunger are structured and arranged so that reciprocal movement therebetween can occur, wherein the volume of the barrel chamber changes with the reciprocal movement. The barrel and the plunger are separated by a first clearance and by a second clearance, with the second clearance being larger than the first clearance. The plunger and the barrel are separated only by the second clearance when the volume of the barrel chamber is near a maximum, wherein pressure across the plunger can equalize by way of the second clearance. The plunger and the barrel are separated by the first clearance when the volume of the barrel chamber is at a minimum, wherein the pump can lift fluid.

In accordance with one aspect of the present invention, the first clearance is between 0.002–0.005 inches and the second clearance is greater than 0.005 inches.

In accordance with still another aspect of the present invention, the second clearance is formed by a taper in an inside diameter of the barrel.

In accordance with still another aspect of the present invention, the second clearance is formed by a taper in an outside diameter of the plunger.

In accordance with still another aspect of the present invention, the second clearance is formed by at least one groove and an inside diameter of the barrel.

In accordance with still another aspect of the present invention, the second clearance is formed by at least one groove and an outside diameter of the plunger.

In accordance with still another aspect of the present invention, the second clearance is formed by grooves in at least one of the plunger or the barrel, the grooves being helical.

In accordance with still another aspect of the present invention, the second clearance is variable in cross-sectional area in a longitudinal direction.

The present invention also provides a downhole pump comprising a barrel and a plunger. The barrel has a first section and a second section coupled together in an end-to-end manner. The first section has a first one-way valve therein. Each of the first and second sections have a respective inside diameter, with the inside diameter of the first section being less than the inside diameter of the second section. The plunger has a second one-way valve therein. The plunger has an outside diameter that is slightly less than the first section inside diameter such that the plunger can reciprocate within the first section and pump fluid while so reciprocating. The plunger has a first end that is closest to the first one-way valve. The plunger has an opening therethrough that is located between the plunger end and the second one-way valve. The opening communicates with an annulus between the barrel second section and the plunger when the opening is within the barrel second section.

The present invention also provides a method of equalizing pressure in a downhole pump that comprises a barrel with a first one-way valve and a plunger with a second one-way valve, there being a chamber located between the first and second one-way valves. The plunger is reciprocated with respect to the barrel so as to expand and contract the chamber between the first and second one-way valves. As the chamber nears an end of its expansion, the channel between the plunger and the barrel is opened around the plunger. This allows any gas present in the chamber to be vented out of the chamber and pressure across the plunger to equalize. The channel is closed as the chamber contracts.

BRIEF DESCRIPTION OF THE DRAWINGS

FIG. 3A shows the pump on the upstroke and FIG. 3B shows the pump on the downstroke.

FIG. 4A shows the pump on the upstroke and FIG. 4B shows the pump on the downstroke.

FIG. 12A shows the pump on the beginning of the upstroke and FIG. 12B shows the pump on the beginning of the downstroke.

DESCRIPTION OF THE PREFERRED EMBODIMENTS

Figure 1:
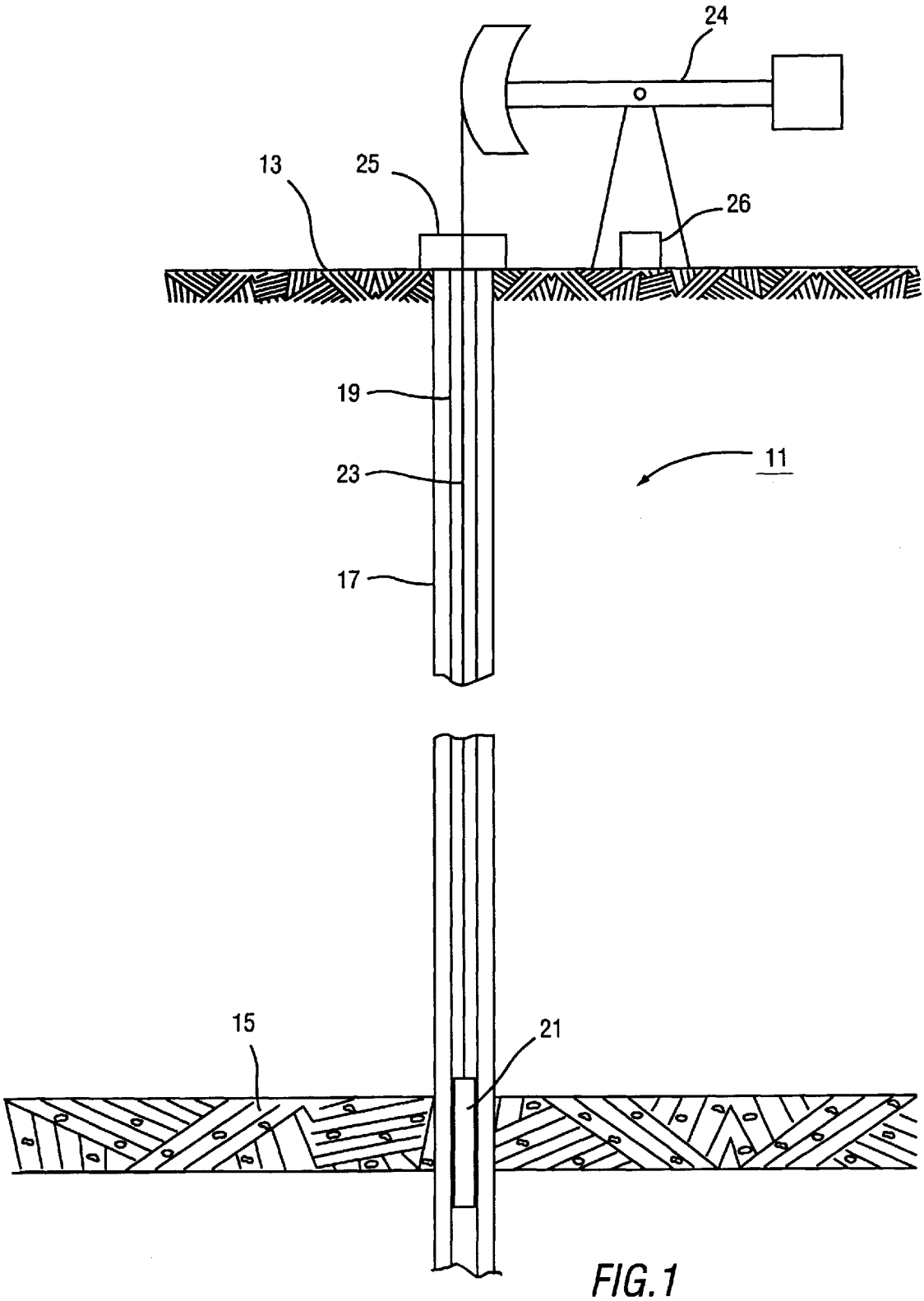
FIG. 1 is a schematic diagram of a well, shown with pumping equipment.

In FIG. 1, there is shown a schematic diagram of a producing oil well 11. The well has a borehole that extends from the surface 13 into the earth, past an oil bearing formation 15.

The borehole has been completed and therefore has casing 17 which is perforated at the formation 15. A packer or other method (not shown) optionally isolates the formation 15 from the rest of the borehole. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod and a stuffing box 25 on the surface 13. The sucker rod string 23 is connected to a pump jack unit 24 which reciprocates up and down due to a prime mover 26, such as an electric motor or gasoline or diesel engine, or gas engine.

Figure 2A:
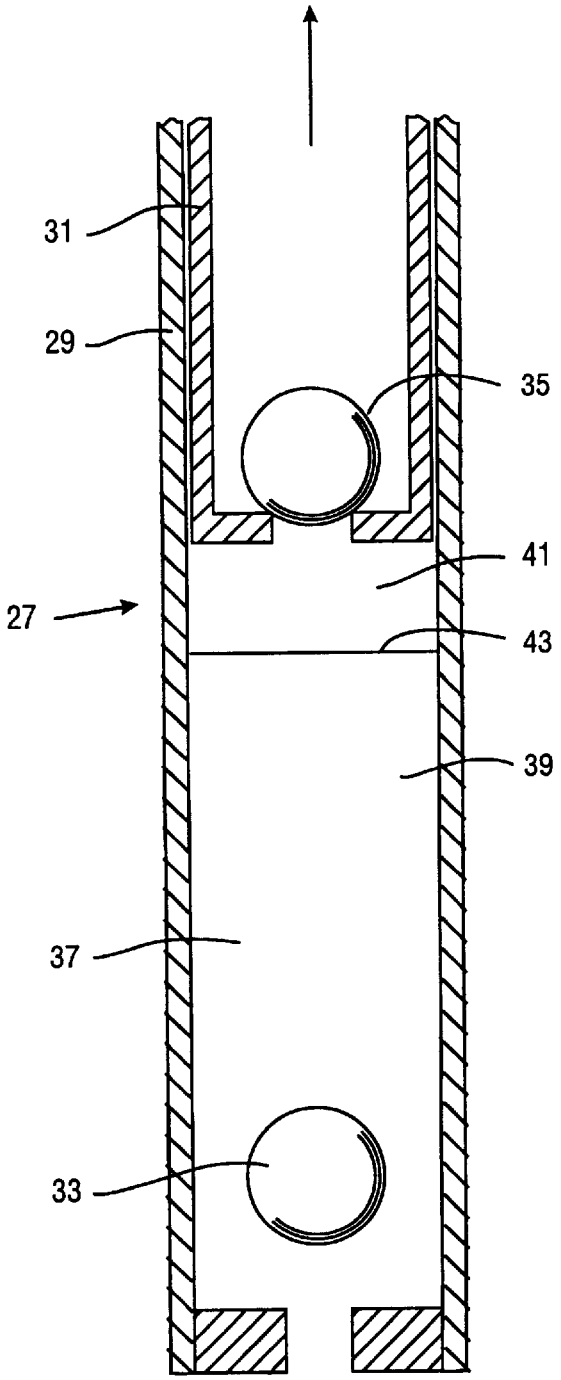
FIG. 2A PRIOR ART FIG. 2B
FIGS. 2A and 2B are longitudinal cross-sectional schematic views of a prior art pump.
Figure 2B:
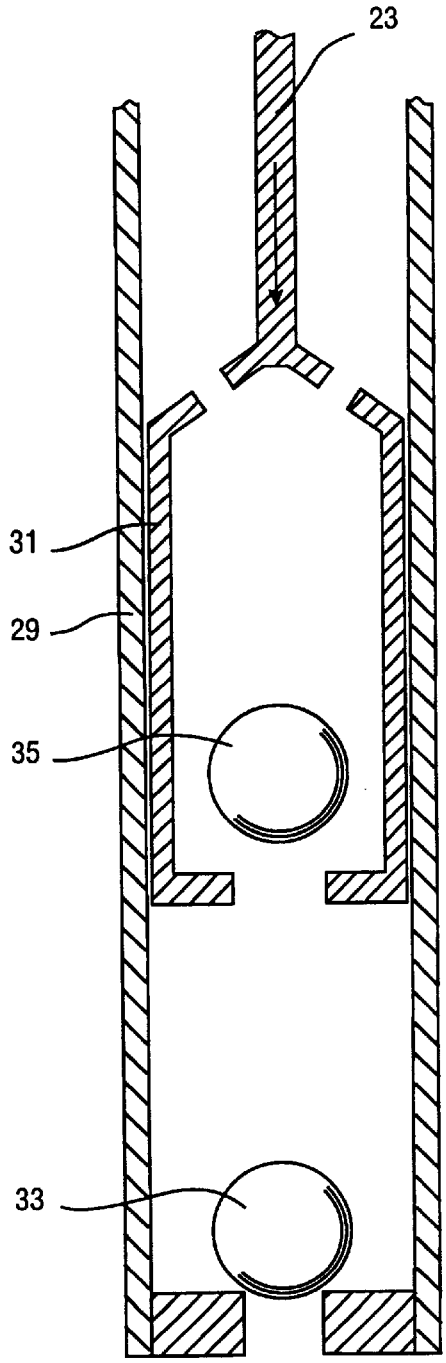
FIG. 2A PRIOR ART FIG. 2B

FIGS. 2A and 2B illustrate a prior art pump 27. In the illustrations, valve cages and other details are not shown in the schematic drawings. The pump 27 has a barrel 29 and a plunger 31 which reciprocates inside of the barrel. The barrel 29 has a standing valve 33 and the plunger 31 has a traveling valve 35.

The plunger is reciprocated inside of the barrel by the sucker rods 23. As the plunger 31 is raised on the upstroke, fluid is drawn into a barrel chamber 37 located between the two valves 33, 35. Ideally, the fluid contains only liquid such as oil 39. However, realistically, the fluid may contain gas 41 as well. The gas rises to the top of the barrel chamber 37, while the oil is located below, or the gas may be distributed throughout the oil 39.

As the plunger descends on the downstroke, it initially passes through the gas 41. However, when the plunger contacts the oil-to-gas interface 43, the change in density jars the pump. Such jarring or mechanical shock can damage the pump, sucker rods and/or tubing.

Figure 3A:
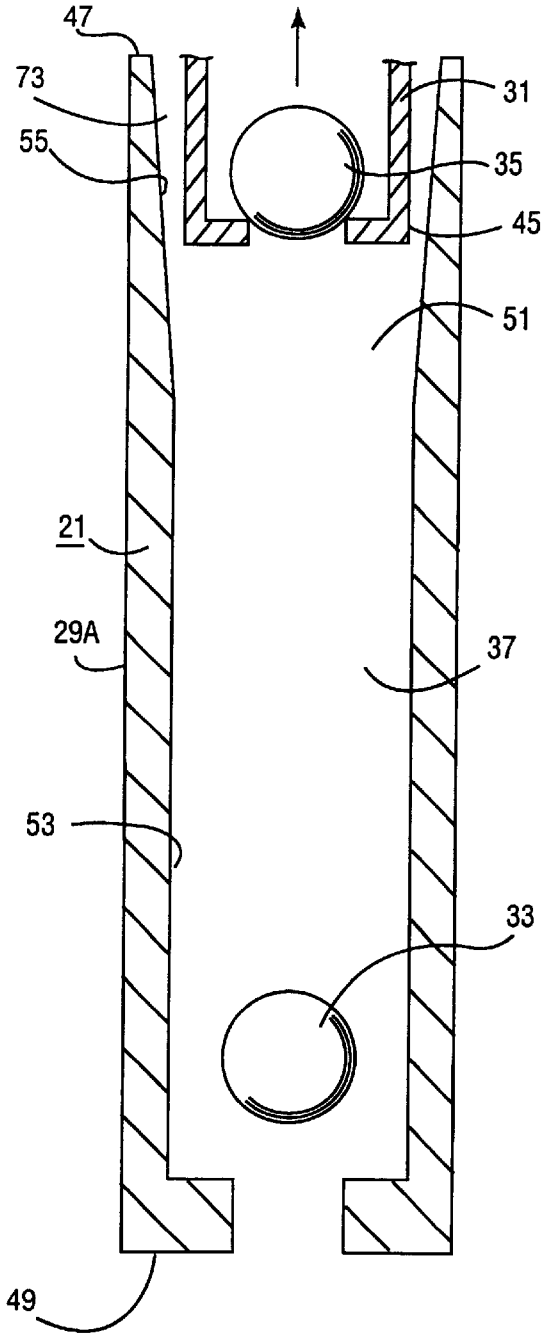
FIGS. 3A and 3B are longitudinal cross-sectional schematic views of a pump of the present invention, in accordance with a preferred embodiment
Figure 3B:
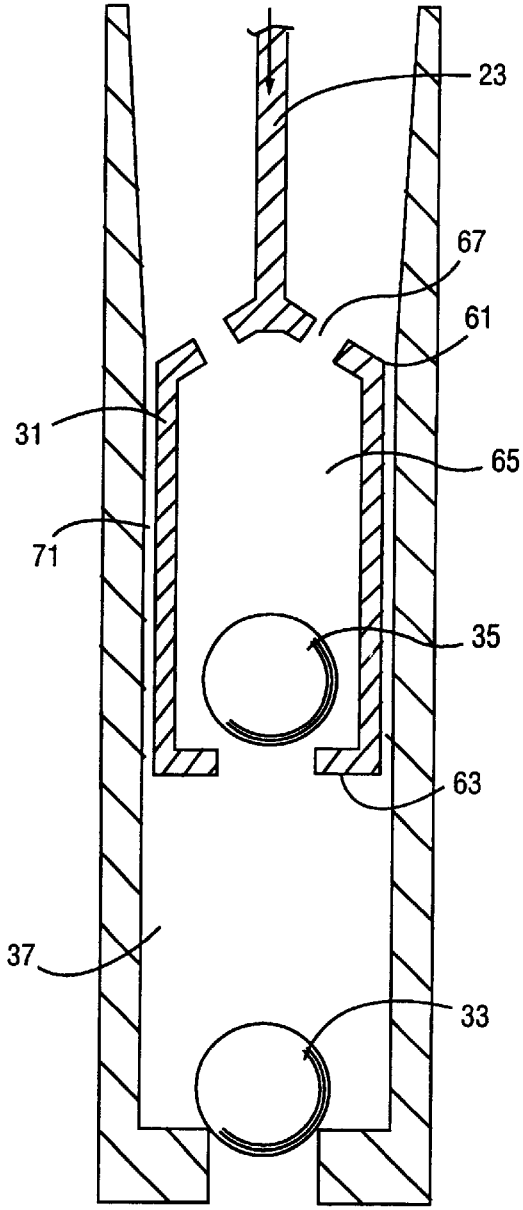

The present invention provides a pump 21 that minimizes, if not preventing outright, such jarring and mechanical shock produced by the plunger passing through an oil-to-gas interface. Referring to FIGS. 3A and 3B, this is accomplished by providing a bypass 45, or fluid/gas channel, around the traveling valve 35 and the plunger 31. The bypass is located near where the plunger 31 completes its upstroke so as to allow much of the upstroke to fill the barrel chamber 37. Thus, as the plunger is raised inside of the barrel on the upstroke, fluid enters the barrel chamber 37 through the standing valve 33. The bypass 45 is initially closed on the upstroke, thereby allowing the chamber 37 to fill with fluid. As the plunger 31 nears the top of the upstroke, it opens the bypass 45 and allows the barrel chamber to be backfilled. Liquid such as oil from above the plunger 31 passes through the bypass 45 into the barrel chamber 37, while gas exits the barrel chamber through the bypass and flows up into the barrel above the plunger, and/or pressure is equalized across traveling valve 35. Thus, the gas is vented from the barrel chamber, and/or pressure is equalized across traveling valve 35, preventing a gas lock condition from occurring.

As the pump is operated on the downstroke, the plunger passes through liquid only and/or equalized pressure, wherein the pump is not subjected to mechanical shock.

With the pump of the present invention, the pump need not be operated in a pump off condition. In addition, sand between the plunger and the barrel is cleaned out on each stroke.

The bypass can be implemented in several ways. One type of bypass is shown in FIGS. 3A and 3B. The pump has a barrel 29A and a plunger 31. The pump is of the upstroke type.

The barrel 29A can be of the insert type or of the tubing type. The barrel 29A is generally cylindrical, having upper and lower ends 47, 49. A cavity 51 extends therethrough between the ends. The cavity is open at the barrel upper end 47. At the lower end 49 of the barrel cavity is a one-way standing valve 33. The standing valve 33 is oriented so as to allow fluid to flow up in the barrel. The lower portion 53 of the cavity is cylindrical. The upper portion 55 of the cavity is tapered and is frusto-conical in shape. The taper is such that the inside diameter of the cavity is greater at the upper end of the tapered portion 55 than at the lower end (in FIGS. 3A and 3B, the taper is exaggerated). The cylindrical and tapered portions 53, 55 of the barrel 29A can be made separately and then coupled together. Alternatively, the barrel can be made as one piece.

The plunger 31 is generally cylindrical with upper and lower ends 61, 63. A cavity 65 extends therethrough between the ends. The upper end 61 of the plunger is connected to the bottommost sucker rod 23. Openings 67 in the plunger upper end 61 allow communication between the plunger cavity 65 and that portion of the barrel cavity 51 that is above the plunger. The lower end 63 of the plunger has the one-way traveling valve 35 that is oriented so as to allow fluid to flow up through the plunger. The plunger outside diameter is cylindrical.

The plunger 31 reciprocates up and down inside of the barrel 29A. Because of this movement, the outside diameter of the plunger 31 is sized slightly smaller (typically 0.002–0.005 inches, and even up to 0.008 inches for heavy crude) than the inside diameter of the barrel cylindrical portion 53. The cylindrical portion 53 of the barrel has the smallest inside diameter of the barrel. The clearance 71 between the plunger 31 and the barrel 29A allows a small amount of oil to enter between the plunger and the barrel, thereby providing lubrication. As the plunger reciprocates inside of the cylindrical portion of the barrel, the amount of oil leaking around the traveling valve through the clearance is negligible.

The clearance 73 between the plunger and the barrel increases from the lower end of the tapered portion 55 to the upper end of the tapered portion. In one embodiment, the clearance increases from 0.002 inches to 0.090 inches.

The taper is at the upper end of the stroke. For example, if the plunger has a stroke length of twelve feet, then the taper is located at the upper three feet of the stroke.

To illustrate how the pump 21 operates, reference is made to FIG. 3A. As the plunger 31 is drawn up inside of the cylindrical portion 53 of the barrel 29A (the upstroke), the standing valve 33 opens and allows fluid to flow therethrough and into the barrel chamber 37. A negligible amount of oil is in the clearance 71 between the plunger and the barrel for lubrication purposes. As the plunger 31 enters the tapered portion 55 of the barrel, the clearance 73 between the plunger 31 and the barrel 29A increases. Any gas that is inside of the barrel chamber 37 can bypass the traveling valve 35 through the clearance 73. As pressure is equalized above and below plunger 31, and traveling valve 35, the gas is vented out of the barrel chamber, and/or pressure is equalized. It is replaced by oil entering the chamber 37. Thus, the chamber 37 is backfilled with a quantity of oil from a location that is above the plunger.

As liquid flows through the bypass clearance 73 into the upper end of the chamber 37, the liquid at the lower end of the chamber may flow back out of the chamber through the standing valve 33. This backflow causes the standing valve 33 to close. This is because although a pressure differential opens the standing valve, fluid flow closes the valve. Once the standing valve 33 is closed, liquid remains in the chamber 37.

As the plunger 31 moves on the downstroke, it moves through liquid and not gas. Consequently, the mechanical shock is reduced or eliminated. In addition, some liquid will escape the chamber 37 through the plunger 31. However, this liquid merely flows into the barrel above the plunger. As the plunger continues to move down, the bypass clearance 71 closes. The traveling valve 35 is open, wherein the fluid in the barrel chamber enters the plunger chamber 65. Fluid inside of and above the plunger chamber 65 is lifted toward the surface on the upstroke.

Figure 4A:
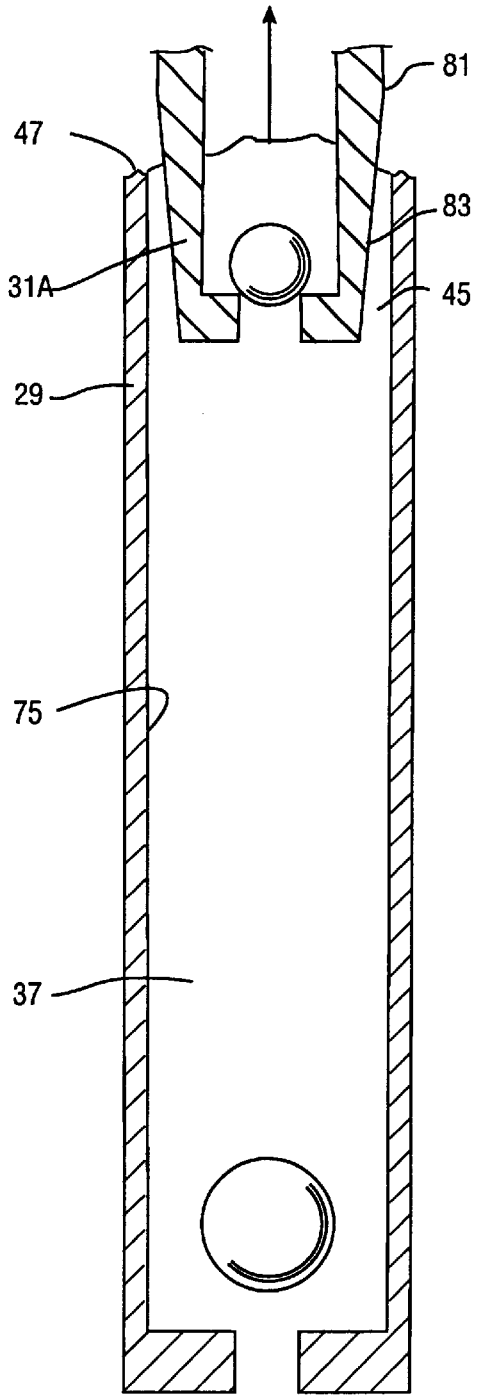
FIGS. 4A and 4B are longitudinal cross-sectional schematic views of a pump in accordance with another embodiment.
Figure 4B:
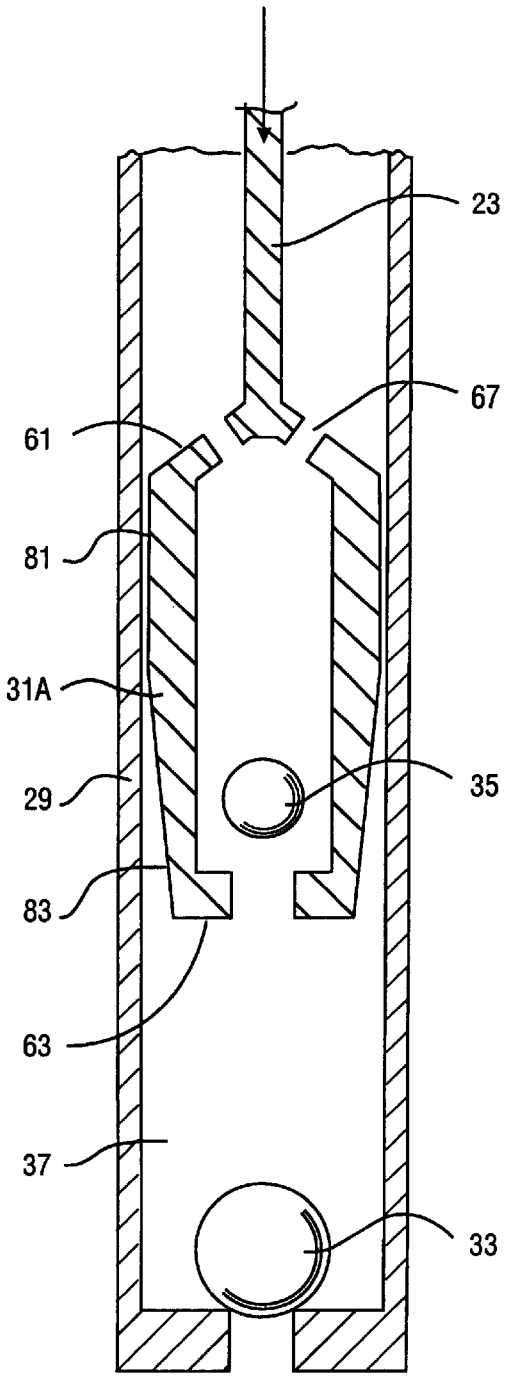

FIGS. 4A and 4B show an alternative embodiment. The barrel 29 has a cylindrical cavity 75. However, the plunger 31A is different as it has a cylindrical section 81 and a tapered section 83 located below the cylindrical section. The cylindrical section 81 has a cylindrical outside diameter, while the tapered section 83 is frusto-conical in shape. The outside diameter of the tapered section 83 is larger at its juncture with the cylindrical section 81 than at the lower end of the plunger 63.

The pump of FIGS. 4A and 4B operates as described above with respect to FIGS. 3A and 3B. At the top of the upstroke, a portion of the tapered section 83 of the plunger clears the upper end 47 of the barrel 29. This creates a bypass 45, allowing the barrel chamber 37 to backfill and vent gas, and/or equalize pressure across traveling valve 35. On the downstroke, the tapered section fully reenters the barrel cavity, thus closing the bypass.

Figure 5:
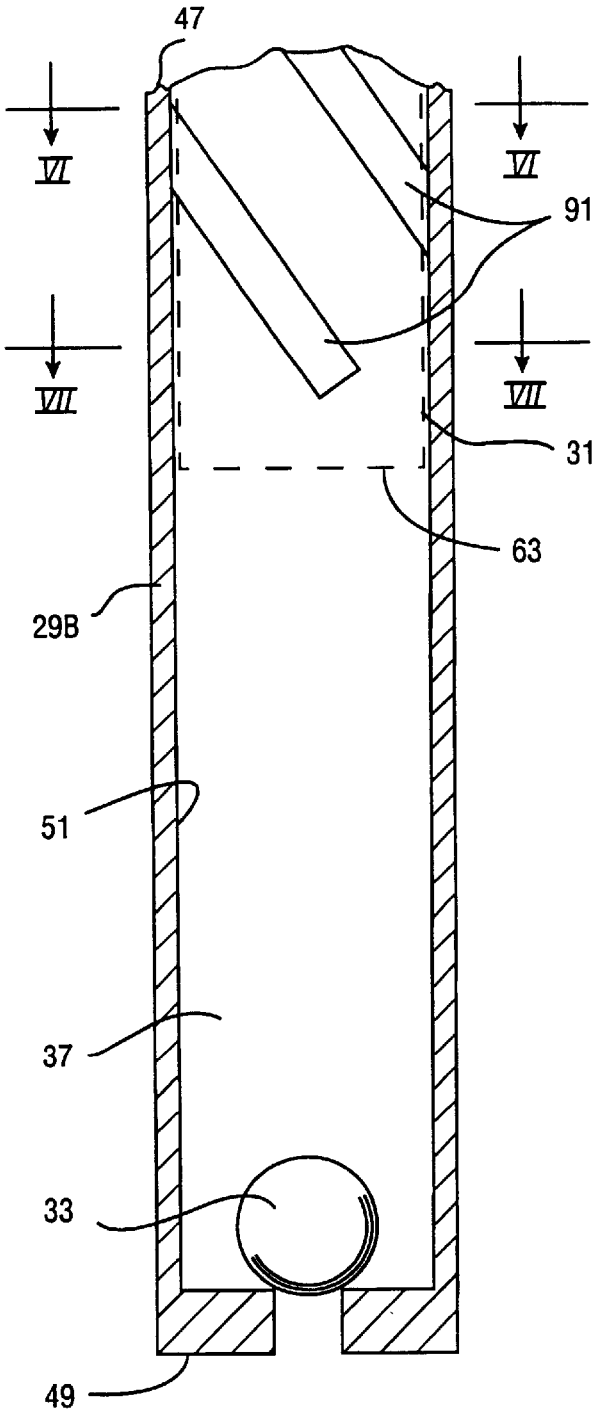
FIG. 5 is a longitudinal cross-sectional schematic view of a barrel of a pump, in accordance with still another embodiment.
Figure 6:
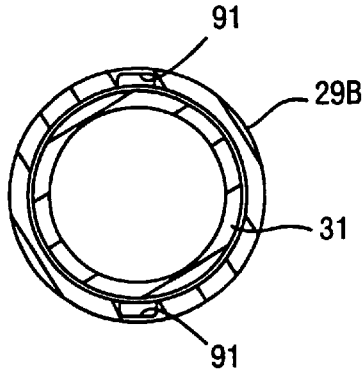
FIGS. 6 and 7 are transverse cross-sectional views of the barrel of FIG. 5, taken respectively along lines VI—VI and VII—VII, together with a plunger.
Figure 7:
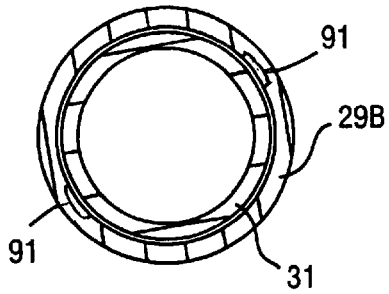

FIGS. 5–7 illustrate another embodiment of the pump. The plunger 31 is substantially the same as the plunger of the embodiment of FIGS. 3A and 3B. (In FIG. 5, the plunger is shown in dashed lines.) The barrel 29B has been modified. The cavity 51 in the barrel has a cylindrical inside diameter from the upper end 47 to the lower end 49. The bypass is created by grooves 91 in the inside diameter of the barrel cavity 51. The grooves can be either helical or straight. The grooves 91 are located at the upper end of the barrel cavity 51. As the plunger 31 nears the top of its stroke, the lower end 63 of the plunger passes the lower end of the grooves, thereby opening the bypass. Liquid can backfill the barrel chamber by flowing through the grooves 91. Likewise, gas can exit the barrel chamber through the grooves. On the downstroke, when the lower end of the plunger passes below the lower end of the channel, the bypass closes.

Figure 8:
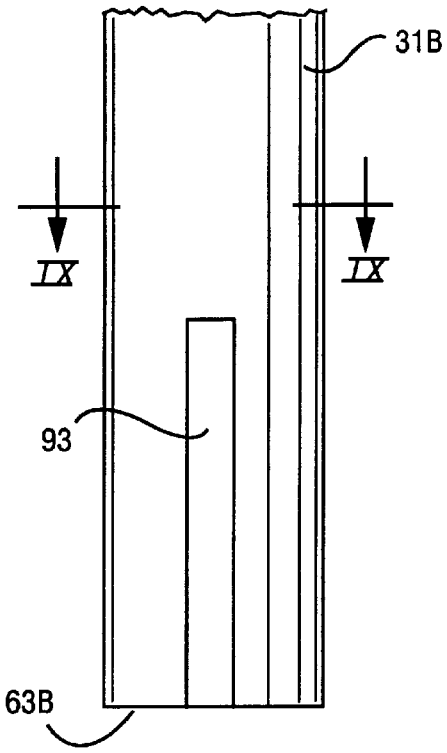
FIG. 8 is a longitudinal schematic view of a plunger of a pump, shown in accordance with another embodiment.
Figure 9:
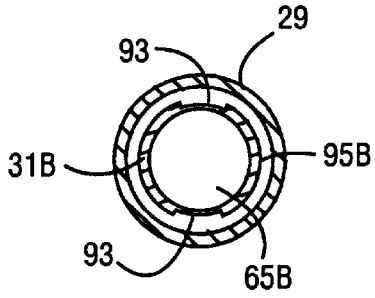
FIG. 9 is a transverse cross-sectional view of a pump incorporating the plunger of FIG. 8, taken along lines IX—IX of FIG. 8.

FIGS. 8 and 9 illustrate still another embodiment of the pump. The barrel 29 is cylindrical, with no taper or grooves in the barrel chamber. However, the plunger 31B has been modified. The outside diameter of the plunger 31B is generally cylindrical from the upper end to the lower end 63B.

The bypass is created by grooves 93 in the outside diameter of the plunger 31B. The grooves 93 do not penetrate into the plunger cavity 65B. The grooves extend from the lower end 63B toward the upper end for a predetermined distance.

The grooves 93 may be straight (as shown in FIG. 8) or helical. Helical grooves 93, whether on the plunger or in the barrel, are thought to have better wearability as the plunger reciprocates inside of the barrel.

As the plunger 31B is pulled up inside of the lower and middle portions of the barrel, the fluid in the plunger cavity 65B is lifted, as is the fluid above the plunger. The clearance 95B between the plunger 31B and the barrel 29 is tight and very little fluid leaks through this clearance. The bypass around the plunger is closed.

As the plunger 31B nears the top of the stroke, the upper end of the grooves 93 open to the space above the barrel. This opens the bypass, wherein liquid can backfill the barrel chamber by flowing through the grooves 93. Likewise, gas can exit the barrel chamber through the grooves. On the downstroke, when the upper end of the grooves 93 reenter the barrel, the bypass closes.

The cross-sectional area (as measured transversely to the longitudinal axis between the upper and lower ends of the pump) of the bypass can vary along the length of the respective component. For example, in FIGS. 3A–4B, the cross-sectional area of the bypass is small at the lower end 63 of the plunger when the bypass is first opened by the plunger moving on the upstroke. As the plunger continues to the top of the upstroke, the cross-sectional area of the bypass at the plunger lower end 63 increases to a maximum, wherein the plunger begins the downstroke.

This variable area bypass is also illustrated in FIGS. 5–7. The depth of the grooves is relatively shallow (FIG. 7) when the bypass is first opened. However, at or near the top of the upstroke, the channel is deeper (FIG. 6). Although two channels have been shown in FIGS. 5–7, the number of channels can be varied depending on the circumstances.

In FIGS. 8–9, the grooves 93 can vary in depth. At the lower end 63B of the plunger 31B, the grooves are relatively deep, while at the upper end of the grooves, the grooves are relatively shallow. This has the effect of initially presenting a small bypass, with the cross-sectional area of the bypass increasing as the plunger nears the top of the upstroke.

A larger bypass allows a faster backfilling of the barrel chamber than does a bypass with a smaller cross-sectional area. By varying the size of the bypass 45 along the upstroke, the rate of backfilling the barrel chamber 37 can be controlled. Thus, in the preferred embodiment, a small amount of backfilling occurs as the plunger is still moving on the upstroke. As the plunger nears the top of the upstroke, the rate of backfilling increases. Thus, much of the backfilling of the barrel chamber occurs just shortly before the plunger begins the downstroke, which is when the chamber should be backfilled with liquid and have little or no gas. By varying the rate of backfilling, the amount of oil lost back into the chamber 37 from above the plunger is minimized.

The cross-sectional area of the bypass grooves 91, 93 (whether the grooves are on the barrel or on the plunger) can be varied by varying the width of the grooves. A wider groove presents a larger bypass than does a narrower groove. The width of the groove can be varied along its length or the width can be constant. A combination of variations in groove depth and width can also be used.

Figure 10:
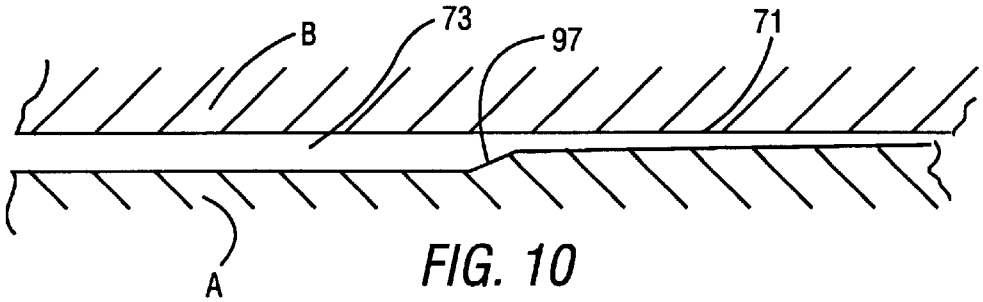
FIG. 10 is a schematic longitudinal view of a portion of a barrel and plunger, showing the clearances therebetween.

The cross-sectional area of the bypass need not be varied but can instead be constant along the longitudinal length of the respective component. For example, with the grooves 91, 93 in the barrel and/or plunger, the depth and width of the grooves can be constant throughout the length of the grooves. If the bypass is made by a taper, then the diameter of the taper is constant, as opposed to variable. As shown in FIG. 10, the taper 73 is shown as being on a part A, which can be either the barrel or the plunger, with part B being the other of the barrel or the plunger. The diameter of the taper 73 is constant, thus presenting a larger clearance between the barrel and the plunger. (The diameter of the taper could be variable.) The transition between the larger clearance 73 and the narrower (or conventional) clearance 71 is made by a short bevel 97, in order to prevent the catching of one of the barrel or the plunger on the other.

In addition, the bypass can be made using a combination of a taper and grooves.

Figure 11:
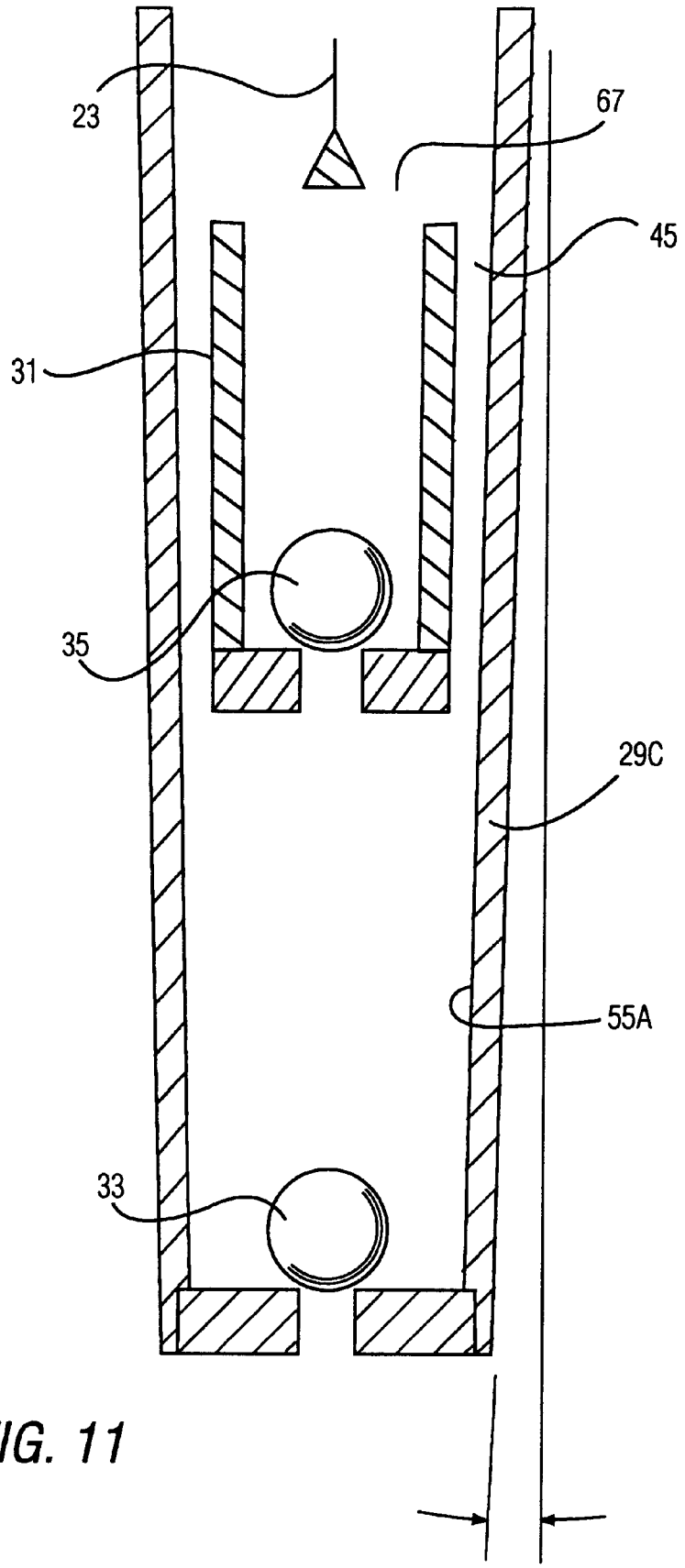
FIG. 11 is a longitudinal cross-sectional schematic view of a pump of the present invention, in accordance with another embodiment.

FIG. 11 illustrates still another embodiment of the pump. This embodiment is similar to the embodiment of FIGS. 3A and 3B. In the pump of FIG. 11, the barrel 29C is tapered 55A for its entire length. The taper can be slight and sized so that substantial venting or backfilling around the plunger 31, which is not tapered, is only for the upper extent of travel of the plunger inside of the barrel. When the plunger is at the bottom of its downstroke, the clearance between the plunger 31 and the barrel 29C is small so as to prevent substantial venting or backfilling therethrough. However, when the plunger is near the top of its upstroke, the clearance is sufficient so as to form a channel 45 around the plunger and to allow substantial venting or backfilling therethrough.

At first glance, the bypass apparatus appears to be counter-intuitive, because it allows fluid to leak past the plunger. In the prior art, the clearance between the plunger and the barrel has been about 0.002–0.005 inches in order to allow reciprocating movement between the plunger and the barrel, to provide for some lubrication between the plunger and the barrel, and to minimize the amount of fluid that can pass through the clearance. However, by positioning the bypass so that it opens near the end of the upstroke, the benefits of allowing fluid to backfill the barrel chamber around the plunger outweigh the disadvantages.

Figure 12A:
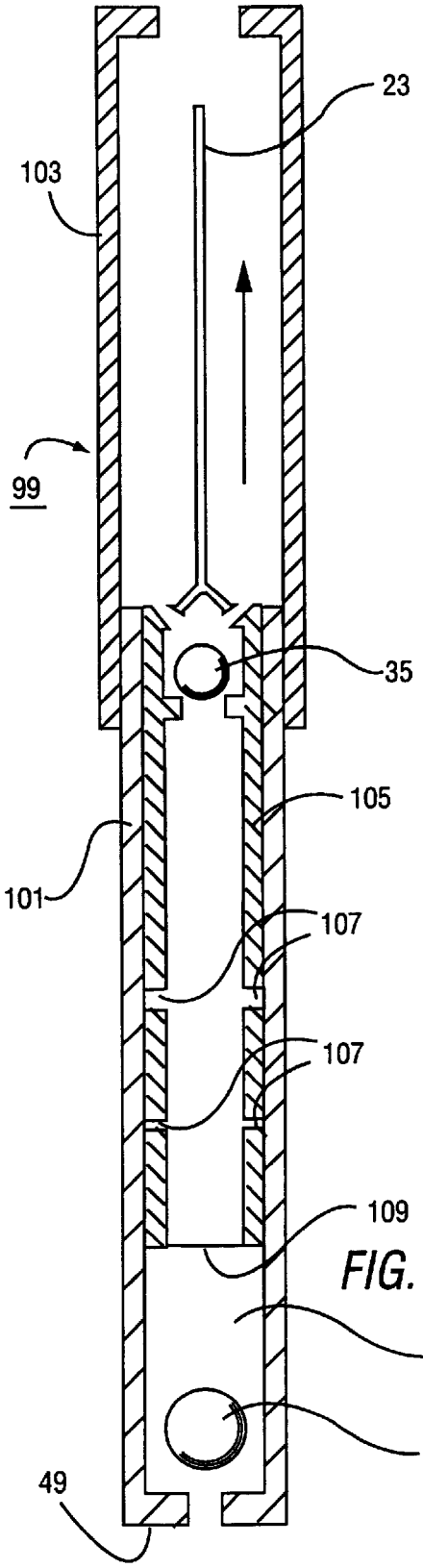
FIGS. 12A and 12B are longitudinal cross-sectional schematic views of a pump of the present invention, in accordance with still another embodiment.
Figure 12B:
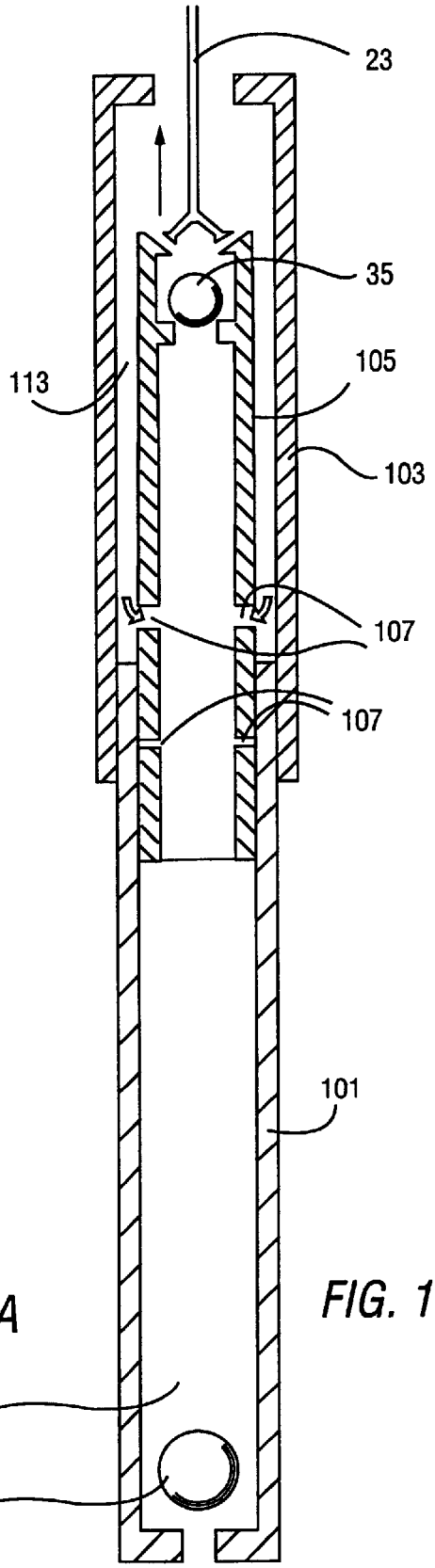

FIGS. 12A and 12B illustrate still another embodiment of the pump 99. The barrel is made in two sections, namely a lower section 101 and an upper section 103, joined together in an end-to-end manner. The lower section 101 has a standing valve 33 at its lower end 49. The upper end of the lower section 101 is received by the lower end of the upper section 103. The inside diameter of the upper section 103 is larger than the inside diameter of the lower section 101. The upper end of the upper section is open to receive the sucker rods 23 and to allow fluid to pass therethrough.

The plunger 105 has an outside diameter that fits into the barrel lower section 101. The clearance between the plunger 105 and the lower section 101 is such that substantial venting or backfilling therethrough is prevented. The plunger 105 has openings 107 therethrough, which openings are located above the lower end 109 of the plunger. The openings 107 can be located along a length of the plunger as shown. In addition, the openings 107 need not be of equal size. The traveling valve 35 is located above the openings 107. In FIGS. 12A and 12B, the traveling valve is shown at the upper end of the plunger. The traveling valve need not be so high; it need only be above the openings 107.

In operation, the plunger 105 is pulled on the upstroke, as shown in FIG. 12A. The chamber 111 between the two valves 33, 35 fills with fluid through the standing valve 33. As the plunger 105 reaches the upper extent of travel (as shown in FIG. 12B), the openings 107 clear the lower section 101 of the barrel and enter the upper section 103. Here, there is much clearance between the plunger and the barrel; in fact an annulus 113 is formed around the plunger. Gas in the plunger can vent to the annulus 113 through the openings 107. Thus, pressure across the plunger (above and below the plunger) is equalized.

On the downstroke, pressure continues to be equalized across the plunger into the openings 107 as plunger 105 reenters the lower section 101 of the barrel. Then, the traveling valve opens and fluid flows therethrough.

The barrel can be made easily by joining the upper and lower sections 103, 101 together.

The pump shown in FIGS. 12A and 12B is particularly suited for a so-called pampa pump. A pampa pump has a short barrel and a long plunger and is used in sandy conditions.

The invention can be utilized on insert type pumps and tubing type pumps. The invention can be used on stationary barrel type pumps, regardless of whether the barrel is top anchored or bottom anchored. The invention can be used on traveling barrel type pumps.

The invention allows a pump to be operated in a gas lock, a gas interference and/or a pump off situation or normal pumping situation. The backflow into the barrel chamber vents gas, which is beneficial in a gas lock, a gas interference, or a pump off situation, while increasing the liquid content of the barrel chamber, which is beneficial in all three situations. In addition, the life of the pump and the sucker rods is extended because of the reduced amount of stress. For example, backfilling the barrel chamber equalizes the pressure across the traveling valve, which reduces the effective stress on the sucker rods.

Like numbers in different figures designate like components.

The foregoing disclosure and showings made in the drawings are merely illustrative of the principles of this invention and are not to be interpreted in a limiting sense.

What is claimed is:

1. A downhole pump, comprising:

a) an unperforated barrel having first and second ends, with a first one-way valve being located in the second end of the barrel;

b) a plunger having first and second ends, the plunger having a second one-way valve therein, the plunger second end being located inside of the barrel such that reciprocal movement between the plunger and the barrel can occur;

c) a barrel chamber inside of the barrel and extending between the first one-way valve and the plunger, the barrel chamber expanding when the reciprocal movement between the plunger and the barrel is an upstroke movement and the barrel chamber contracting when the reciprocal movement between the plunger and the barrel is a downstroke movement;

d) a bypass channel located between the plunger and the barrel, the bypass channel being closed when the reciprocal movement is beginning the upstroke movement and being open when the reciprocal movement is near an end of the upstroke movement, the open bypass channel allowing communication from the barrel chamber around the plunger.

2. The pump of claim 1 wherein the plunger comprises an outside diameter, the bypass channel being formed by a reduction of the outside diameter near the plunger second end.

3. The pump of claim 1 wherein the plunger comprises an outside diameter, the bypass channel being formed by at least one groove in the outside diameter extending in a generally longitudinal direction along the plunger, the groove being located near the plunger second end.

4. The pump of claim 1 wherein the bypass channel has a cross-sectional area that increases as the reciprocal movement between the plunger and the barrel nears the end of the upstroke movement.

5. The pump of claim 1 wherein the barrel comprises an inside diameter, the bypass channel comprising an increase of the inside diameter near the barrel first end.

6. The pump of claim 1 wherein the barrel comprises an inside diameter, the bypass channel comprising at least one groove in the inside diameter extending in a generally longitudinal direction along the barrel, the groove being located near the barrel first end.

7. A downhole pump, comprising:

a) a barrel;

b) a plunger having one end located inside of the barrel, the plunger end forming part of a chamber inside of the barrel;

c) the barrel and the plunger being structured and arranged so that reciprocal movement therebetween can occur, wherein the volume of the barrel chamber changes with the reciprocal movement;

d) the barrel and the plunger being separated by a first clearance and by a second clearance, with the second clearance being larger than the first clearance, the plunger and the barrel being separated only by the second clearance when the volume of the barrel chamber is near a maximum, wherein the pressure across the plunger can equalize by way of the second clearance, the plunger and the barrel being separated by the first clearance when the volume of the barrel chamber is at a minimum, wherein the pump can lift fluid.

8. The pump of claim 7 wherein the first clearance is between 0.002–0.005 inches and the second clearance is greater than 0.005 inches.

9. The pump of claim 7 wherein the second clearance is formed by a taper in an inside diameter of the barrel.

10. The pump of claim 7 wherein the second clearance is formed by a taper in an outside diameter of the plunger.

11. The pump of claim 7 wherein the second clearance is formed by at least one groove in an inside diameter of the barrel.

12. The pump of claim 7 wherein the second clearance is formed by at least one groove in an outside diameter of the plunger.

13. The pump of claim 7 wherein the second clearance is formed by grooves in at least one of the plunger or the barrel, the grooves being helical.

14. The pump of claim 7 wherein the second clearance is variable in cross-sectional area in a longitudinal direction.

15. A downhole pump, comprising:

a) a barrel having a first section and a second section coupled together in an end-to-end manner, the first section having a first one-way valve therein, each of the first and second sections having a respective inside diameter, the inside diameter of the first section being less than the inside diameter of the second section;

b) a plunger having a second one-way valve therein, the plunger having an outside diameter that is slightly less than the first section inside diameter such that the plunger can reciprocate within the first section and pump fluid while so reciprocating;

c) the plunger having an end that is closest to the first one-way valve, the plunger having an opening therethrough located between the plunger end and the second one-way valve, the opening communicating with an annulus between the barrel second section and the plunger when the opening is within the barrel second section.

16. A method of venting gas or equalizing pressure in a downhole pump comprising a barrel with a first one-way valve and a plunger with a second one-way valve, there being a chamber located between the first and second one-way valves, comprising the steps of:

a) reciprocating the plunger with respect to the barrel so as to expand and contract the chamber between the first and second one-way valves;

b) as the chamber nears an end of its expansion, opening a channel between the plunger and the barrel and around the plunger, wherein any gas present in the chamber can be vented out of the chamber and/or pressure can be equalized across the second one-way valve;

c) closing the channel as the chamber contracts.

* * * * *